US010948195B2

(12) United States Patent
Grobleben et al.

(10) Patent No.: US 10,948,195 B2
(45) **Date of Patent: *Mar. 16, 2021**

(54) COOKING APPLIANCE COMPRISING A DOOR OPENING MECHANISM FOR AUTOMATICALLY MOVING A DOOR INTO AN INTERMEDIATE POSITION, AND METHOD FOR OPENING A DOOR OF A COOKING APPLIANCE

(71) Applicant: BSH Hausgeräte GmbH, Munich (DE)

(72) Inventors: Ralf Grobleben, Bretten (DE); Tobias Schmidt, Munich (DE); Thomas Rembold, Lehrensteinfeld (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/419,034

(22) Filed: May 22, 2019

(65) Prior Publication Data

US 2019/0271474 A1 Sep. 5, 2019

Related U.S. Application Data

(63) Continuation of application No. 15/774,613, filed as application No. PCT/EP2016/078105 on Nov. 18, 2016, now Pat. No. 10,408,465.

(30) Foreign Application Priority Data

Dec. 18, 2015 (DE) ..... 102015226009.7

(51) Int. Cl.
*F24C 15/02* (2006.01)
*E05D 15/58* (2006.01)
(Continued)

(52) U.S. Cl.
CPC ..... *F24C 15/026* (2013.01); *E05D 15/582* (2013.01); *E05F 1/1261* (2013.01);
(Continued)

(58) Field of Classification Search
CPC .... F24C 15/023; F24C 15/026; E05F 15/627; E05F 1/1075; E05F 1/276; E05F 1/1261;
(Continued)

(56) References Cited

U.S. PATENT DOCUMENTS 3,127,889 A * 4/1964 Mills ..... F24C 15/026 126/194
3,838,538 A * 10/1974 Burford ..... F24C 15/023 49/258

(Continued)

*Primary Examiner* — Daniel J Rohrhoff
(74) *Attorney, Agent, or Firm* — Michael T. Schupp; Andre Pallapies; Brandon G. Braun

(57) ABSTRACT

A cooking appliance includes a housing having a stowage compartment, a door for closing a cooking chamber, and a door opening mechanism constructed to automatically move the door at least in a section of an entire movement path between a closed position and an open position of the door, in which open position the door is retractable into the stowage compartment of the housing. The door opening mechanism includes an actuation unit which is configured to automatically tilt the door from the closed position into an intermediate position located such that any further movement of the door from the intermediate position into the open position is implemented automatically under the force of gravity of the door.

16 Claims, 5 Drawing Sheets

(51) Int. Cl.
*E05F 15/627* (2015.01)
*E05F 1/12* (2006.01)
*E05F 1/10* (2006.01)

(52) U.S. Cl.
CPC ..... *E05F 1/1276* (2013.01); *E05F 15/627* (2015.01); *E05D 2015/586* (2013.01); *E05F 1/1075* (2013.01); *E05Y 2201/426* (2013.01); *E05Y 2800/22* (2013.01); *E05Y 2800/236* (2013.01); *E05Y 2900/308* (2013.01)

(58) Field of Classification Search
CPC ..... E05D 15/582; E05D 2015/586; E05Y 2201/426; E05Y 2800/236; E05Y 2900/308
See application file for complete search history.

(56) References Cited

U.S. PATENT DOCUMENTS 4,726,352 A * 2/1988 Radke ..... F24C 15/026 126/190
7,064,296 B1 * 6/2006 Harned ..... F24C 15/026 126/190
7,255,101 B2 * 8/2007 Grutzke ..... E05D 15/36 126/190
7,261,100 B2 * 8/2007 Bartmann ..... F24C 15/023 126/192
7,755,004 B2 * 7/2010 Collene ..... F24C 15/023 126/192
8,047,198 B2 * 11/2011 Meyer ..... F24C 15/023 126/190
8,710,409 B2 * 4/2014 Busalt ..... E05F 15/63 219/402
10,408,465 B2 * 9/2019 Grobleben ..... E05F 1/1261
2004/0108441 A1 * 6/2004 Bettinzoli ..... E05F 1/1246 248/565
2004/0255929 A1 * 12/2004 Miller ..... F24B 1/192 126/500
2005/0034381 A1 * 2/2005 Bartmann ..... F24C 15/024 52/79.1
2006/0289530 A1 * 12/2006 Cordae ..... F24C 15/026 219/756
2007/0267402 A1 * 11/2007 Harned ..... F24C 15/006 219/392
2018/0087779 A1 * 3/2018 Maldonado ..... F24C 15/162

* cited by examiner

COOKING APPLIANCE COMPRISING A DOOR OPENING MECHANISM FOR AUTOMATICALLY MOVING A DOOR INTO AN INTERMEDIATE POSITION, AND METHOD FOR OPENING A DOOR OF A COOKING APPLIANCE

CROSS-REFERENCE TO RELATED APPLICATIONS

This application is a continuation, under 35 U.S.C. § 120, of U.S. application Ser. No. 15/774,613, filed May 9, 2018, now allowed, which is the U.S. National Stage of International Application No. PCT/EP2016/078105, filed Nov. 18, 2016, which designated the United States and has been published as International Publication No. WO 2017/102244 A2 and which claims the priority of German Patent Application, Serial No. 10 2015 226 009.7, filed Dec. 18, 2015, pursuant to 35 U.S.C. 119(a)-(d).

BACKGROUND OF THE INVENTION

The invention relates to a cooking appliance comprising a door for closing a cooking chamber of the cooking appliance. The door is lowerable into a stowage compartment in a housing of the cooking appliance. The cooking appliance further comprises a door opening mechanism for automatically moving the door at least in some sections of an entire movement path extending between a closed position and an open position of the door. Furthermore, the invention also relates to a method for opening such a door of a cooking appliance.

In cooking appliances it is known that the actuation of the door and thus an alteration to the position may be provided manually by a user himself, by the user directly gripping the door, in particular a handle, and bringing about the opening of the door by a pulling force. In these embodiments it is provided that the door is effectively moved over its entire movement path by the user himself into the respective positions.

In this connection it is also known that such a door is not only able to be pivoted about a fixed axis relative to the housing but that this stowage compartment is also configured in the housing of the cooking appliance, the door then being able to be inserted into said stowage compartment.

In such embodiments with a stowage compartment, the movement path of the door is relatively complex. Moreover, the hinges required therefor and the corresponding guidance of the movement of the door into the stowage compartment are more complex. Since such a door of a cooking appliance also has a relatively large weight due to thermal requirements and stability requirements, the guidance of the movement has to be designed in this case such that an undesirably hard impact does not occur.

In order to increase the user-friendliness it is also known that such a door may be moved via an electrical drive, independently of the guidance by a user and thus the direct manual movement of the door by a user. Such an embodiment is disclosed, for example, in DE 199 06 913 A1. Here the entire movement path is performed via an electrical drive until the door is fully lowered in the stowage compartment. In this embodiment, however, the electrical drive has to be designed to be correspondingly large and with a high electrical output. This is because with a relatively heavy door forces occur in the movement path which in practice then have to be taken up by the electrical drive in order to be able to guide the movement over this entire path via said drive.

Such electrical drives of large dimensions require a large amount of space, a large amount of energy and, therefore, are also very cost-intensive.

BRIEF SUMMARY OF THE INVENTION

It is the object of the present invention to provide a cooking appliance and a method for opening a door of such a cooking appliance, in which the movement of the door into the stowage compartment is improved by the automatic guidance of the movement of the door at least in some sections.

This object is achieved by a cooking appliance and a method according to the independent claims.

A cooking appliance according to the invention comprises a door for closing a cooking chamber of the cooking appliance. The cooking appliance further comprises a housing in which a stowage compartment is configured, the door being lowerable into said stowage compartment when opened. The cooking appliance also comprises a door opening mechanism for automatically moving the door and guiding the movement of the door independently of the user. The door opening mechanism is configured for automatically moving the door at least in some sections of an entire movement path extending between a closed position and an open position of the door. An essential idea of the invention may be seen to be that this door opening mechanism includes an actuating unit by means of which the door can be automatically tilted from the closed position only into an intermediate position. The intermediate position is characterized in that the further movement of the door from the intermediate position into the open position, in which the door is retracted into the stowage compartment, is also performed automatically but without assistance from the actuating unit and thus only under the force of gravity of the door itself. In this embodiment, therefore, the movement of the door from the closed position into the open position is, in particular, fully automatic. This means that this movement of the door takes place without directly acting on the door and thus without a user producing a pulling force on the door. A movement of the door which is independent of the user, therefore, is provided. In the invention, however, the guidance of the movement is initiated only over a quite specific path section of the entire movement path between the closed position and the open position, via a drive motor of the actuating unit. In this regard, the guidance of the movement takes place in practice in the movement path section between the closed position and the intermediate position. By means of this relatively short path, therefore, the door is tilted quite specifically by the actuating unit. From the intermediate position, therefore, the actuating unit is no longer effective and/or deactivated in this regard, relative to a further movement of the door driven by motor. Since, in practice, a motorized assistance of the movement is implemented via the actuating unit as far as this characterized intermediate position, this movement path may be performed without interruption so that in this regard the opening of the door as far as this intermediate position may be carried out smoothly and without jamming. Particularly advantageously, therefore, by means of this intermediate position a position is reached in which a further movement of the door, due to the force of gravity, is carried out from the intermediate position into the open position by the weight force of the door.

By means of such an embodiment, the actuating unit in particular with its motorized drive may be designed to be small. As a result, constructional space may be saved and the actuating unit does not have to be designed to be as powerful relative to its motorized action in order to be able to take up the forces which are present in the case of positions of the door tilted at a greater angle. As a result, lower requirements are set for the actuating unit so that a more energy-efficient operation of this design of motorized drive is also achieved.

Advantageously, it is provided that the entire movement sequence of the door, in particular from the closed position into the open position, is initiated by a user actuating an operating element of the cooking appliance, wherein this automatic opening process takes place as a function of this actuation. The operating element may be produced in many different embodiments. It may be a touch-sensitive operating element. However, the operating element may also be a push button or a rocker switch or the like. Equally, for example, the operating element may also be designed for recognizing a gesture and thus able to be actuated in a contactless manner. It may also be provided that the operating element is configured for voice recognition and a corresponding voice command is issued by a user in order to initiate this automatic opening process.

In particular, it is provided that the intermediate position is reached with a tilt angle of between 15° and 30°, in particular between 18° and 22°, in particular 20° relative to the closed position of the door. In particular, the closed position of the door is that where the door is oriented vertically. Due to the relatively small angular interval starting from the closed position, the motorized drive power via the actuating unit is significantly reduced. Nevertheless, a position is reached where the weight force of the door effects the further movement from the intermediate position into the open position and/or initiates the further automatic downward movement.

Preferably, it is provided that the actuating unit comprises an electromechanical device which is connected by at least one Bowden cable to a cam follower. This cam follower is connected, in particular, to a hinge arm of a hinge. The pivoting and retraction of the door into the stowage compartment is permitted by the hinge. The cam follower is mechanically coupled to this hinge arm, wherein the cam follower is pivotable about a pivot axis by a pulling force acting on the cam follower via the Bowden cable and as a function of this pivoting movement the hinge arm is pivotable such that the door is automatically tiltable from the closed position into the intermediate position. Such a specific embodiment of the actuating unit firstly permits a robust embodiment so that corresponding movement sequences and transmissions of force may be permitted in a reliable and continuous manner. Secondly, the guidance of the movement and the initiation of the movement are possible here in a very accurate manner. Undesirable tolerances during the movement of the door are avoided thereby. Moreover, by means of this embodiment undesirable tolerances are prevented from being able to occur at the respective coupling points which then could also accumulate. The actuating unit also comprises within the scope of the electromechanical device a motorized drive and/or a motor, the movement of the Bowden cable being achieved thereby. This embodiment also enables, in particular, the motor to be able to be arranged remotely from the hinge arm and also the cam follower. As a result, improvements which are specific to the constructional space may be achieved. At the points where the hinge is arranged, the embodiment is free of large components of the actuating unit. As a result, the entire guide mechanism of the door may be kept unaltered and is not subject to any structural restrictions. Moreover, it is then also possible that the motor of the electromechanical device may be arranged at a location which, relative to thermal loads of the cooking appliance during operation, also has no negative effects on the function of this motor.

In particular, it is provided that the hinge has a hinge housing, the hinge arm being rotatably connected thereto, and the cam follower is pivotably arranged on the hinge housing. In particular, the door is directly connected to the hinge arm. Since the cam follower is directly coupled to the hinge housing, correspondingly occurring forces may also be transmitted in an improved manner here, since the hinge housing is also a more robust and larger component than the hinge arm. Moreover, by this specific coupling point the design of the connection between the hinge arm and the door is in turn not compromised and the corresponding relative movements between the door and the hinge arm are not impaired during the movement of the door. In particular, the cam follower is also pivotably arranged relative to the hinge arm.

In particular, it is provided that the hinge arm is an integral bracket which preferably has a U-shape. Two rollers which are arranged spaced apart from one another are arranged on the hinge arm, in particular on a limb of this U-shape, said rollers being rotatable. By means of these rollers, the hinge arm engages in guide tracks which are formed on the narrow vertical side edges of the door. As a result, a mechanically stable guidance is provided, but with the possibility of a smooth relative movement between the hinge arm and the door. This has advantages, in particular, for the movement of the door into the stowage compartment and for the movement paths which are present at the same time between the door and the hinge arm.

Advantageously, it is provided that guide tracks are formed on the housing on lateral walls which define the stowage compartment, in each case a guide carriage being guided in said guide tracks. The guide carriages configured on opposing sides are preferably connected to a connecting rod so that the position thereof may be maintained relative to one another and regarding the movement no tilting or twisting occurs relative to one another. By this positional coupling between the guide carriages a movement into the stowage compartment which is smooth and even is permitted along the guide tracks on the walls defining opposing sides. The door is advantageously connected at its lower end to these guide carriages, in particular rotatably connected thereto. The guide carriages are separate components from the hinge arms. The guide carriages are attached to the door in a fixed and thus non-displaceable manner, wherein at the attachment point a rotational axis is formed, the door being able to rotate about said rotational axis relative to a guide carriage. Accordingly, by means of the hinge arms with the rollers already mentioned above, not only is a movement permitted with regard to a relative rotation but by means of the guide grooves and/or guide tracks in the door, which are also configured on the side edges and already mentioned above, a relative displacement movement is also provided between the door and a hinge arm.

In particular, it is provided that the electromechanical device comprises a motorized drive as already mentioned. The electromechanical device also comprises a lifting wheel which is rotatable by the motorized drive and a lifting rod which is connected to the lifting wheel. The lifting rod is movable in a linear manner by a rotation of the lifting wheel, in particular displaceable upwardly and downwardly in the vertical direction. As a function of this movement of the lifting rod, the Bowden cable which is coupled to the lifting rod is able to be actuated. These specific components of the electromechanical device and the operative connection thereof may also in turn permit a finely adjusted and accurate transmission of movement to the Bowden cable and therefrom in turn to the cam follower. As a result, the movement of the cam follower may be carried out in a very metered and finely adjusted manner which in turn has a corresponding effect on a correspondingly metered movement of the door. An abrupt opening of the door and/or springing-back of the door or rocking to and fro of the door is thereby prevented.

By means of the lifting wheel and the lifting rod the force produced by the motorized drive is thus also transmitted without interruption and smoothly.

In particular, a cable lever is connected to the lifting rod, the at least one Bowden cable being fastened to said cable lever. By the movement of the lifting rod, the cable lever which is movable thereby is actuated and thus a corresponding pulling force is exerted on the Bowden cable.

Preferably, it is provided that by a complete revolution of the lifting wheel by 360°, by the chain reaction between the lifting wheel and the hinge arm the door is moved from the closed position into the intermediate position. In particular, by this single complete revolution of the lifting wheel the cam follower is automatically returned to its initial position. By this specific rotational movement by a single complete revolution of the lifting wheel, on the one hand, the required maximum path of the cam follower is achieved, starting from its initial position and/or basic position into a rotated position, in which the hinge arm is moved such that the door is located in the intermediate position and, on the other hand, it is also achieved that the cam follower is automatically returned again from its related maximum pivoted position into this basic position. By the related uniform revolution of the lifting wheel, very even movements are also transmitted to the cam follower, which then in turn is able to move very evenly out of the basic position into the maximum deflected position and from this maximum deflected position again back into the basic position. Thus even in the case of a single actuation movement of the lifting wheel, the initial position is automatically achieved repeatedly by such a complete revolution.

In particular, it is provided that the hinge housing has a main spring with a first spring hardness, wherein the main spring is coupled to an auxiliary spring with a second spring hardness which is lower relative to the first spring hardness. The hinge housing of this hinge is movable on the movement path between the closed position of the door and the intermediate position of the door relative to a fixed attachment point of the auxiliary spring. The hinge is configured for pivoting and retracting the door into the stowage compartment. By this embodiment of the auxiliary spring and the main spring quite specific spring forces may be produced for different sections of the movement path of the door. As a result, on the one hand, the movement path section between the closed position and the intermediate position and, on the other hand, the movement path section between the intermediate position and the open position, are individually and advantageously assisted. In a particularly advantageous manner, by means of this embodiment it is also achieved that, in particular, the main spring is inactive on the first movement path section between the closed position and the intermediate position, and thus does not yet act with a spring force and, on the other hand, advantageously the main spring acts to a specific degree on the second movement path section between the intermediate position and the open position of the door. As a result, it is advantageously implemented on the second movement path section, in which the further downward tilting of the door is caused by the force of gravity of the door itself, that the door does not tilt downward unbraked, thus producing an undesired hard impact, but by this opposing spring force of the main spring, this downward tilting movement of the door which is only initiated by the force of gravity takes place in a metered and cushioned manner. By means of this embodiment, therefore, a particularly advantageous implementation of the entire guidance of the movement is achieved. In particular, when the main spring does not act with its spring force on the first movement path section, this motorized drive of the door from the closed position into the intermediate position is not undesirably impeded. Thus a spring force of the main spring does not counteract the motorized drive.

Advantageously, it is provided that the main spring is connected to the auxiliary spring via a coupling rod. By this direct connection a direct interaction is also provided between the two springs. As a result, force may be transmitted in a very direct and undistorted manner. In particular, the coupling rod is configured to be rigid per se, whereby these aforementioned advantages may be achieved in a further improved manner.

Preferably, it is provided that the main spring and the auxiliary spring are connected, in particular, via a coupling rod such that on the movement path section between the closed position of the door and the intermediate position of the door the auxiliary spring is able to be compressed and the main spring is not compressed. The related advantages already cited above may be achieved here to a specific degree. As a result, it is possible that the movements of the hinge housing are sprung and damped by the auxiliary spring to a certain degree, so that even here the movement from the closed position of the door into the intermediate position is advantageously damped to a certain degree. By the relatively low spring hardness of the auxiliary spring in this regard, however, an undesirably high force does not act counter to the motorized drive of the electromechanical device.

Since the two spring hardnesses of the main spring and the auxiliary spring are selected entirely individually and the first spring of the main spring is greater than the second spring hardness of the auxiliary spring, the main spring in this movement path between the closed position and the intermediate position of the door remains effectively unaltered and is not compressed or expanded.

Preferably, it is provided that a longitudinal axis of the main spring is arranged in parallel or in a linear extension relative to a longitudinal axis of the auxiliary spring. The above-mentioned interaction between the auxiliary spring and the main spring with regard to the alteration of the length thereof in quite specific movement path sections is further improved and more accurate as a result. By this arrangement, a deformation of a spring from the respective linear alignment is also avoided and thus an undesired distortion of the entire movement sequence is avoided. A deflection of a spring to the side is similarly prevented thereby.

Preferably, it is provided that the auxiliary spring is arranged in a spring cup which is positioned in a fixed manner. As a result, the auxiliary spring is also arranged so as to be protected to a certain degree and lateral deformation is prevented in an improved manner. Moreover, the auxiliary spring is guided by the spring cup, with regard to its compression and expansion. Moreover, this spring cup thus also forms a robust mechanical stop for the main spring when the main spring bears against the spring cup with the hinge housing when the intermediate position is reached and, with a further movement on the second movement path section of the door, then the expansion of the main spring takes place.

In particular, it is provided that in the closed position of the door the hinge housing is arranged spaced apart from the spring cup and when the intermediate position is reached the hinge housing is arranged so as to bear against the spring cup. When moving the door between the closed position and the intermediate position, therefore, the hinge housing is then also moved relative to the auxiliary spring and thus relative to the spring cup thereof, and thus toward the spring cup, in particular moved in a linear manner relative thereto. When the intermediate position is reached, the spring cup thus forms a stop for the hinge housing and the main spring arranged therein. Thus the hinge housing is then also held securely in position for the further movement of the door into the open position, so that the basic position of the main spring per se is not altered as a complete spring on this further movement path of the door to the open position but the main spring is simply expanded per se, whereby the desired spring force is applied for restraining the door from an undesirable hard impact when moving into the stowage compartment. From the intermediate position the hinge housing is thus blocked relative to the spring cup.

In particular, on the movement path between the closed position and the intermediate position of the door and thus on this first movement path section the main spring is inactive relative to a spring force to be effected by an alteration in length.

Advantageously, it is provided that on the movement path of the door between the intermediate position and the open position and thus also the aforementioned second movement path section the main spring is able to be expanded and a spring force which is present due to the expansion, counteracts the movement of the door due to the force of gravity. The advantages which are achievable thereby have already been described above.

In a further embodiment, it may also be provided that instead of the electromechanical device at least one lifting magnet is formed in the actuating unit, which also then permits the automatic movement of the door between the closed position and the intermediate position. In a further embodiment, it may also be provided that instead of two separate springs, namely a main spring and an auxiliary spring which are coupled together, only one progressive main spring is formed.

Moreover, the invention also relates to a method for opening a door of a cooking appliance, wherein the door is lowered into a stowage compartment in a housing of the cooking appliance. The door is automatically moved by a door opening mechanism of the cooking appliance at least in some sections of an entire movement path extending between a closed position and an open position of the door. An essential idea of the method according to the invention may be seen to be that starting from the closed position the door is automatically tilted only into an intermediate position by an actuating unit of the door opening mechanism. The intermediate position is characterized in that the further movement of the door from the intermediate position into the open position, in which the door is retracted into the stowage compartment, is also performed automatically and without assistance from the actuating unit and thus also without being driven by motor and only by the force of gravity of the door itself and thus by the weight force thereof. The resulting advantages have already been mentioned above relative to the cooking appliance.

The automatic movement of the door from the closed position into the intermediate position is implemented, in particular, by being driven by motor or via a lifting magnet device.

This automatic movement over the entire movement path between the closed position and the open position of the door, however, is divided into different concepts effecting the automated operation—in particular partially motor driven and partially only due to the force of gravity or partially by a lifting magnet device and partially due to the force of gravity—and these then act in different movement path sections in each case individually.

Advantageous embodiments of the cooking appliance may be regarded as advantageous embodiments of the method according to the invention, wherein the components according to the invention and cited in each case in the cooking appliance permit individually or in cooperation with one another in each case the resulting method steps.

The terms "above", "below", "front", "rear", "horizontal", "vertical" "depth direction", "width direction", "vertical direction", etc. indicate the positions and orientations as provided when the appliance is used as intended and arranged as intended, and when an observer is positioned in front of the appliance and looks in the direction of the appliance.

Further features of the invention are disclosed from the claims, the figures and the description of the figures. The features and combinations of features disclosed above in the description, and the features and combinations of features cited hereinafter in the description of the figures and/or shown individually in the figures, are not only able to be used in the respectively provided combination but are also able to be used in other combinations without departing from the scope of the invention. Thus embodiments of the invention which are not explicitly shown and described in the figures but are revealed from the described embodiments and are able to be produced by separate combinations of features, are to be regarded as encompassed and disclosed. Moreover, embodiments and combinations of features which thus do not have all of the features of an originally formulated independent claim may be regarded as disclosed. Moreover, embodiments and combinations of features, in particular by means of the embodiments set forth above, which go beyond or deviate from the combinations of features set forth in the related claims are to be regarded as disclosed.

BRIEF DESCRIPTION OF THE DRAWINGS

Exemplary embodiments of the invention are described in more detail hereinafter with reference to schematic drawings, in which.

DETAILED DESCRIPTION OF EXEMPLARY EMBODIMENTS OF THE PRESENT INVENTION

Figure 1:
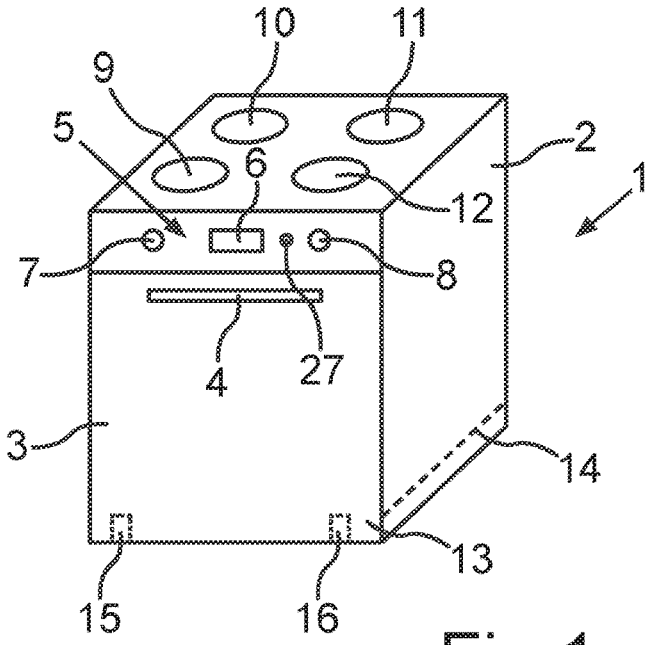
FIG. 1 shows a perspective view of an exemplary embodiment of a cooking appliance according to the invention.

In the figures, elements which are the same or functionally the same are provided with the same reference numerals.

In FIG. 1 a cooking appliance 1 which is configured as an oven is shown in a schematic perspective view. The cooking appliance 1 comprises a housing 2 in which a cooking chamber defined by a muffle, not shown, is configured. In the cooking chamber, food may be introduced for preparation. The cooking chamber is able to be closed on the front face by a door 3 which in FIG. 1 is shown in the closed position. A handle 4 is configured on the front face of the door 3.

Moreover, the oven has an operating device 5 which in terms of position and display has merely by way of example one display unit 6 and operating elements 7 and 8.

Moreover, in terms of position and number the cooking zones 9, 10, 11 and 12 are also shown merely by way of example.

The door 3 may be inserted and/or lowered in its lower region 13 into the housing 2 which is the case when transferring the door 3 from the closed position shown in FIG. 1 into the fully open position. The door 3 is then arranged inserted and lowered into a free space of the housing 2, wherein to this end a stowage compartment 14, which is arranged below the cooking chamber and separated therefrom by a corresponding partition, is formed by this free space.

The door 3 is connected to door hinges 15 and 16, shown and identified by way of example, and pivotable thereby and able to be retracted into and extended out of the aforementioned stowage compartment 14.

Figure 2:
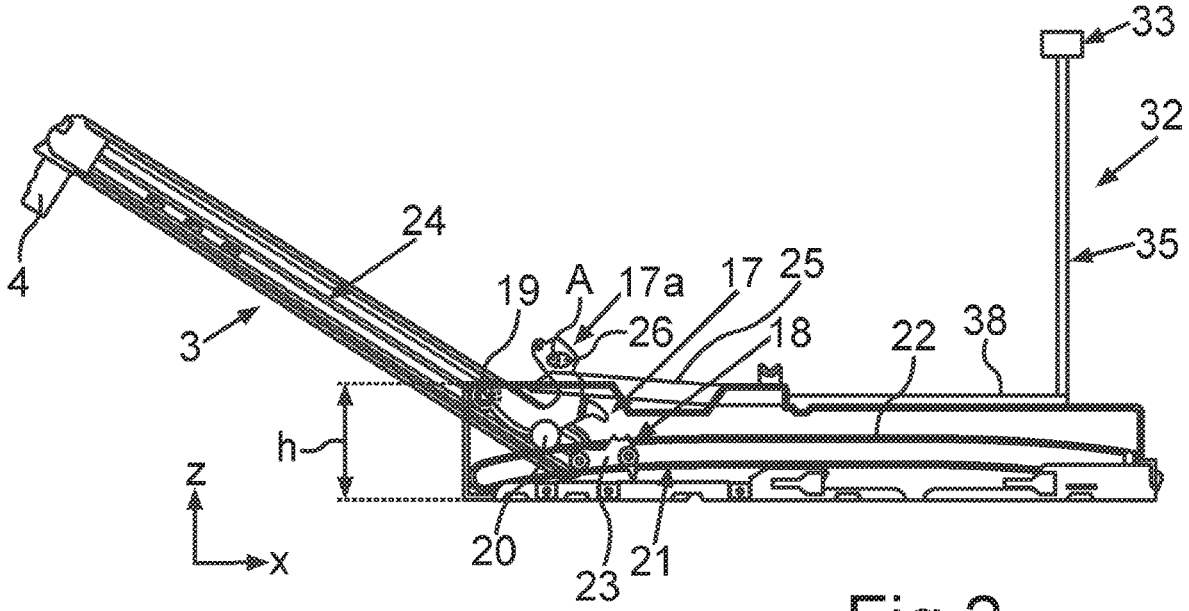
FIG. 2 shows a schematic side view of partial regions of the cooking appliance according to FIG. 1 with a partially open door.

In FIG. 2 in a schematic and merely partial side view relative to the components present, the cooking appliance 1 in the lower region is shown with the partially open door 3. A bearing unit 17 of a hinge 15 and/or 16 is shown. The hinges 15 and 16 are configured, in particular, to be structurally the same and functionally the same, so that the following description of one of the two hinges 15 and 16 in each case also applies to the other.

The hinges 15 and 16 also have in addition to one respectively provided bearing unit 17 one respective hinge housing 25. These hinges 15 and 16 are, in particular, in each case also assigned to a guide mechanism 18 relative to components and functions. The door 3 is guided in terms of movement by means of these guide mechanisms 18 which are also configured to be structurally the same and as a result correspondingly coupled so that they are guided into the stowage compartment 14 and out of the stowage compartment 14. The bearing unit 17 comprises, in particular, a U-shaped bearing bracket and/or hinge arm 17*a*. The hinge arm 17*a* is preferably rotatable about a pivot point which is arranged on a rotational axis A which extends in FIG. 2 perpendicular to the plane of the figures. The bearing unit 17 is also connected to the hinge housing 25 and pivotable relative to the hinge housing 25. The bearing unit 17 comprises two guide elements 19 and 20 which are configured as rollers and arranged so as to be rotatably mounted on the hinge arm 17*a*.

In FIG. 2 a vertical height h is illustrated which shows the extent of a technical part 21 which belongs to the guide mechanism 18. The technical part 21 describes, in particular, a component which also has a groove and/or a guide track 22, in which one respective guide carriage 23 is guided when sliding the door 3 into the stowage compartment 14. The guide carriage 23 is part of the guide mechanism 18. The door 3 at its lower end is rotatably connected to the guide carriage 23. The pivot point in this case is fixed to the door 3 and thus not displaceable in terms of position.

In contrast, the hinge arm 17*a* is coupled both rotatably and displaceably relative to the door 3 and thus as a complete component on the door 3 is able to be altered in its position relative thereto. To this end, on one respective side edge of the door 3 a linear guide track 24 and/or groove is formed into which the guide elements 19 and 20 are received and along which they slide as a function of the movement of the door 3. Both opposing narrow vertical side edges of the door 3 in each case have such a guide track 24.

As may also be identified in FIG. 2, the hinge 15 at this point also comprises a hinge housing 25 which is shown here only as a sketch. The hinge housing 25 is rotatably connected to the hinge arm 17*a*.

Figure 3:
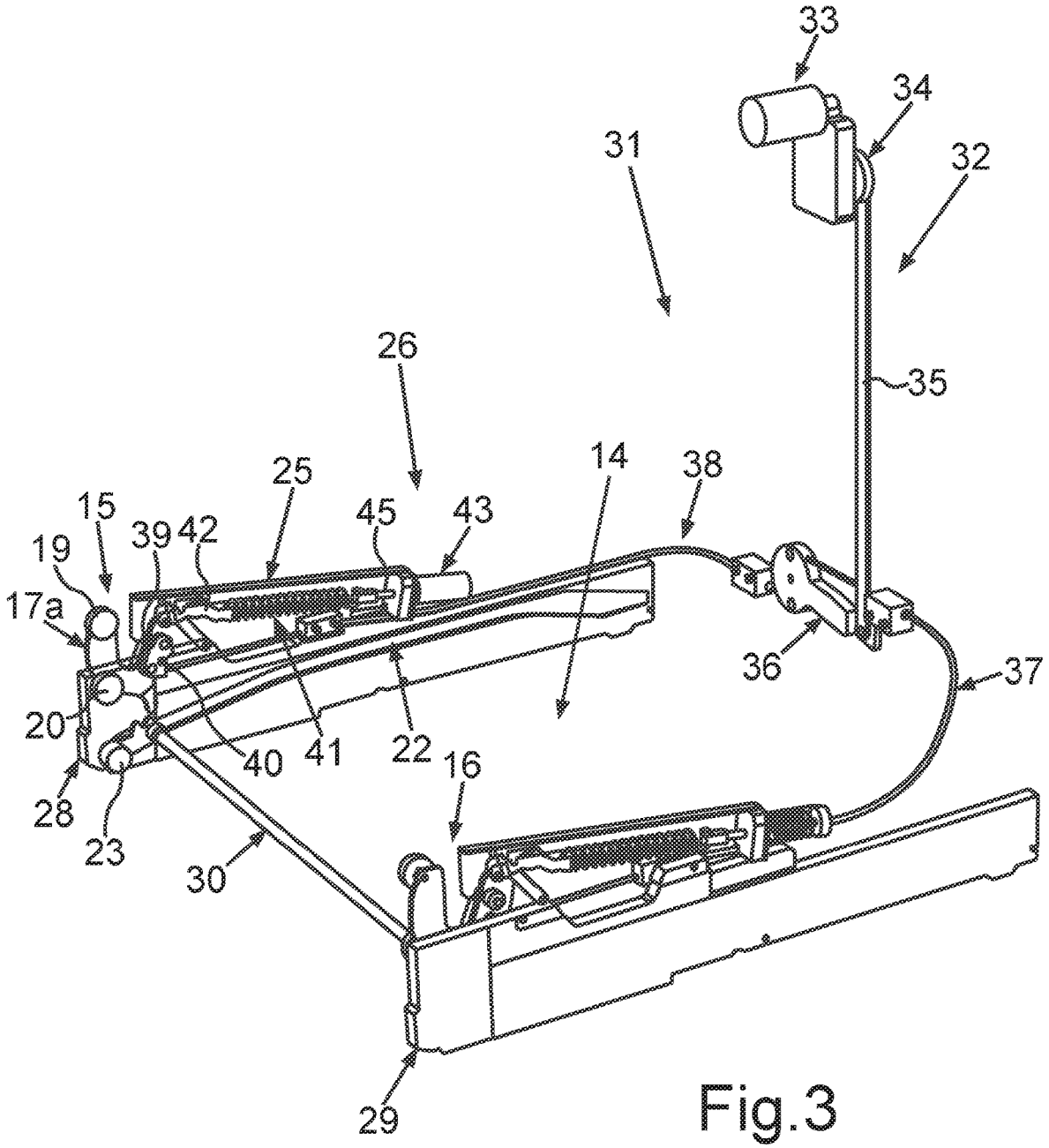
FIG. 3 shows a perspective view of partial components of an actuating unit of the cooking appliance.

In a perspective view in the exemplary embodiment a door opening mechanism 26 by which the door 3 may be automatically moved from its closed position into an open position is shown in FIG. 3. This automatic movement is, however, divided into different concepts effecting the automatic movement and these then act individually in each case in different movement path sections. This door opening mechanism 26 may be initiated via an operating element 27 (FIG. 1). The position and design of the operating element 27 in FIG. 1 is to be understood merely by way of example. The operating element 27 may, for example, be a push button which is pushed by a user.

In FIG. 3 it is also shown here that the stowage compartment 14 is laterally defined by the walls 28 and 29 of the technical part 21. The already mentioned guide tracks 22 are formed on the inner faces of these walls 28 and 29, in each case facing the stowage compartment.

As may also be identified in FIG. 3, the guide carriages 23 which are coupled to the opposing guide tracks 22 are connected to a connecting rod 30 which is rigid per se.

The hinge housing 25 in FIG. 3 is shown in a cut-away and/or broken-away state so that it is possible to see into the interior.

In FIG. 3 it may be identified that the door opening mechanism 26 in the embodiment shown has an actuating unit 31 by which the automatic movement of the door 3 may be implemented. This automatic movement means that without a specific action of a user on the door 3 and thus without any force produced, in particular a pulling force on the door 3 by a user, the door 3 may nevertheless be opened, driven by motor.

Starting from the closed position, this actuating unit 31 is configured to tilt the door 3 automatically only into an intermediate position, in particular driven by motor. This intermediate position is characterized in that at this point the further movement of the door 3 from the intermediate position into the open position, fully retracted into the stowage compartment 14, is performed automatically and without further assistance and thus only by the weight force of the door 3 itself without being driven by motor by the actuating unit 31.

The actuating unit 31 comprises an electromechanical device 32. The electromechanical device 32 has in the exemplary embodiment a motorized drive and/or a motor 33. Moreover, this electromechanical device 32 has a lifting wheel 34 which is driven by the motor 33, in particular rotated. Moreover, the electromechanical device 32 has, in particular, a linear lifting rod 35 which is connected to the lifting wheel 34. A cable lever 36 is arranged at a lower end of the lifting rod 35 remote from the lifting wheel 34. The cable lever 36 is rotatably connected to this lower end of the lifting rod 35. Two separate Bowden cables 37 and 38 are attached to this cable lever 36. The Bowden cables 37 and 38 in each case extend to cam followers of the electromechanical device 32. A cam follower 39 is arranged on the hinge 15. In particular, it is provided here that the cam follower 39 is rotatably fastened to the hinge housing 25, in particular to a coupling element 40, which may be a coupling pin, of the hinge arm 17*a*. This coupling element 40 is fastened fixedly to the hinge arm 17*a*, whereas the cam follower 39 is also rotatably fastened to the hinge arm 17*a*. In a corresponding embodiment, a cam follower is also arranged on the hinge 16 and connected to the Bowden cable 37. As may be identified in the view according to FIG. 3, the Bowden cable 38 is connected to the cam follower 39.

Figure 5:
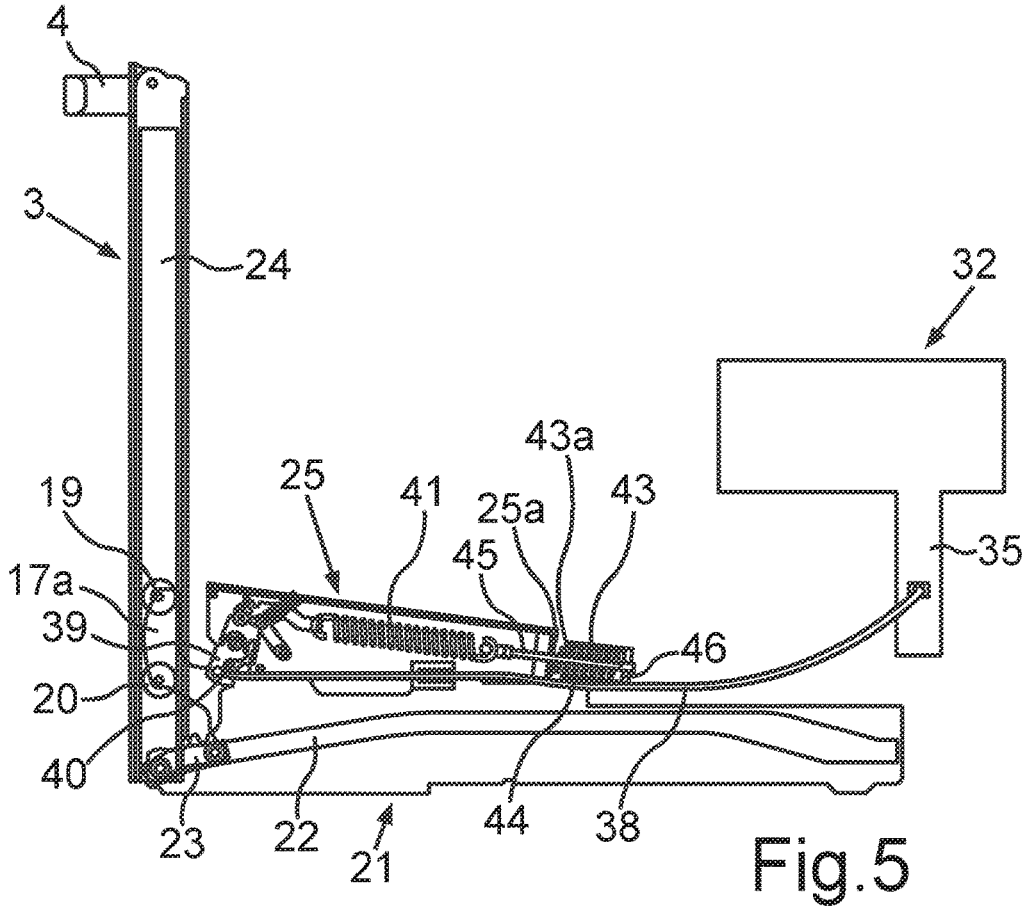
FIG. 5 shows a side view of the components according to FIG. 3 and FIG. 4 with an additional view of the door in the closed position.

Moreover, it is also provided that the actuating unit 31 in the hinge housing 25 has a main spring 41. The main spring 41 is connected via a connection 42 to the hinge arm 17*a*. Moreover, in particular a spring cup 43 is arranged outside the hinge housing 25 and separately therefrom, said spring cup in particular being arranged in the housing 2. An auxiliary spring 44 (FIG. 5) is arranged in the spring cup 43. The auxiliary spring 44 has a second spring hardness which is lower than a first spring hardness of the main spring 41.

The main spring 41 in the form of its, in particular, spiral spring is arranged relative to its longitudinal axis parallel and/or coaxial in series relative to the longitudinal axis of the auxiliary spring 44 which is also configured, in particular, as a spiral spring. The main spring 41 is connected to the auxiliary spring 44 via a coupling rod 45 which is rigid per se. The auxiliary spring 44 is fastened by a rear end fixedly to an attachment point 46 which, in particular, is in the spring cup 43.

In a corresponding embodiment, but provided without further reference numerals, the same is provided in the hinge 16.

Figure 4:
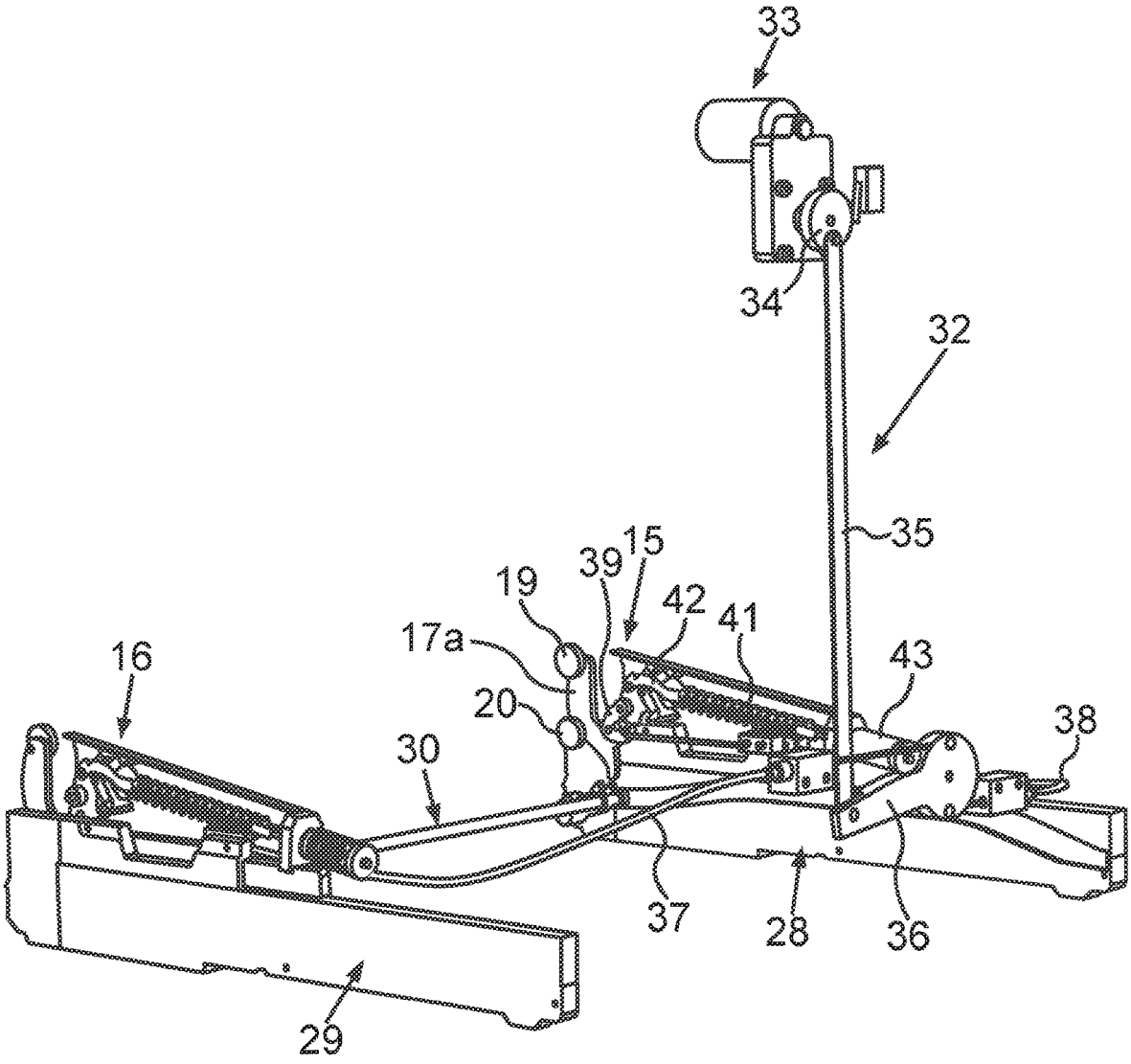
FIG. 4 shows a view of the components according to FIG. 3 in a different perspective view.

In FIG. 4 the component arrangement according to FIG. 3 is shown in a different perspective thereof. For further explanation, reference is made hereinafter to FIG. 5. In this view, the door 3 is shown in the closed state. Here, in particular, the door is arranged so as to be oriented vertically. In this closed state a rear end 25*a* of the hinge housing 25 is spaced apart from a front end 43*a* of the spring cup 43 facing the hinge housing 25.

Figure 6:
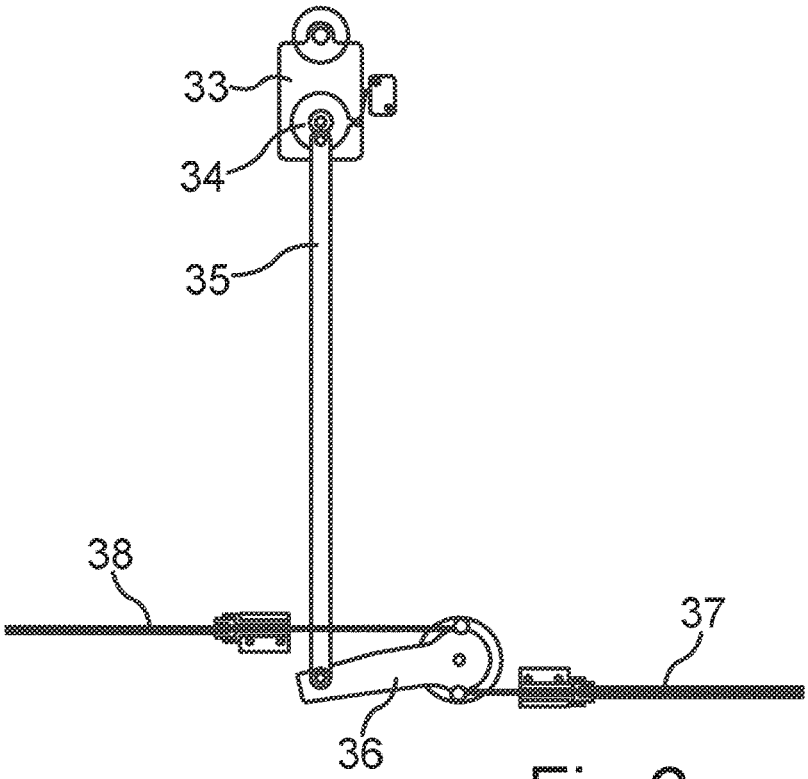
FIG. 6 shows a view of components of an electromechanical device of an actuating unit in a first operating position.

In FIG. 6 the related operating position of the lifting wheel 34, the lifting rod 35 and the cable lever 36 are shown.

If an opening of the door 3 is now desired, a user may actuate the operating element 27. As a result, the automatic opening of the door 3 is initiated. The drive 33 is then started via a control unit. Then the lifting wheel 34 is rotated, starting from the basic position shown in FIG. 6. As a result, the lifting rod 35 is raised and the cable lever 36 is moved into a relatively more horizontal position. By the movement and the positional alteration of the cable lever 36 associated therewith, the Bowden cables 37 and 38 are pulled. This effects in turn a corresponding pulling on the cam followers 39 shown in FIG. 5 in the basic position. By this pivoting of the cam followers 39 to the rear from the basic position, a pulling force and thus a pivoting of the hinge arm 17*a* of the hinge 15 and of the corresponding hinge arm of the hinge 16 are effected. As a result, the door 3 is moved from the closed position shown in FIG. 5 into an intermediate position shown in FIG. 7. The intermediate position of the door 3 is at an angle $\alpha$ of between in particular 18° and 22°, preferably 20°, relative to the vertical and thus, in particular, the closed position of the door 3 shown in FIG. 5.

It is provided that this automatically produced movement of the door 3, driven by motor, is only performed as far as this intermediate position. The motorized movement is then no longer carried out hereinafter from the intermediate position into the fully open position of the door 3 which is retracted into the stowage compartment 14. Starting from the intermediate position of the door 3, the door has reached a tilted position from which, by its own weight force and thus also automatically due to weight force, it tilts further downward and then retracts into the stowage compartment 14. Thus a motorized automatic movement of the door 3 is performed only on the short tilting path between the closed position according to FIG. 5 and the intermediate position according to FIG. 7. On the further tilting path from the intermediate position into the open position of the door 3, the motor 33 is inactive and/or deactivated.

Figure 7:
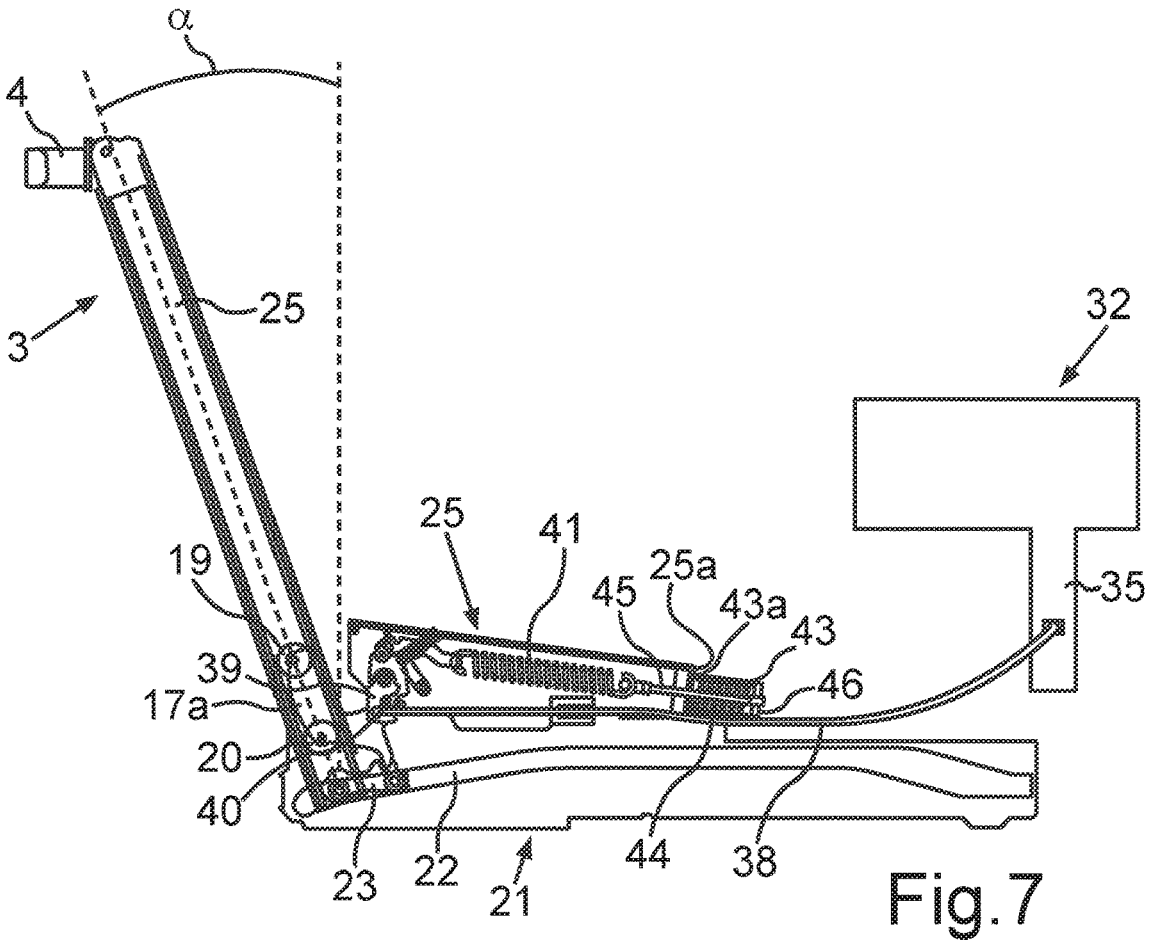
FIG. 7 shows the view of the components according to FIG. 5 with a door arranged in contrast thereto in an intermediate position.

In particular, it is also provided that on this first movement path section between the closed position of the door 3 and the intermediate position of the door 3, the main spring 41 substantially remains, in particular, entirely unaltered in terms of length and thus is neither compressed nor expanded. By the action of the cam follower 39, the hinge housing 25 is pushed in the direction of the spring cup 43 until it strikes against the front end 43*a* of the spring cup 43 in the intermediate position of the door 3 according to FIG. 7 with the rear end 25*a*. This is also shown in FIG. 7. Thus on the first movement path section between the closed position and the intermediate position of the door 3 only the auxiliary spring 44 is compressed, wherein here due to the variable spring hardnesses the main spring 41 is displaced in the direction of the auxiliary spring 44 and the compressive force produced by this displacement is transmitted via the coupling rod 45 to the auxiliary spring 44.

Once this intermediate position is reached and the hinge housing 25 and the spring cup 43 bear directly against one another, which is associated with the intermediate position, with a further opening movement of the door 3 the main spring 41 is expanded, wherein the hinge housing 25 continues to bear against the spring cup 43. By the expansion of the main spring 41, a spring force is produced which acts counter to the force of gravity of the door 3, so that a further unbraked tilting of the door 3 is performed downwardly from the intermediate position into the open position. By this expansion of the main spring 41 and the resulting spring force produced, therefore, a certain cushioning and/or damping of the second movement path section of the door 3 is achieved from the intermediate position into the open position.

Figure 8:
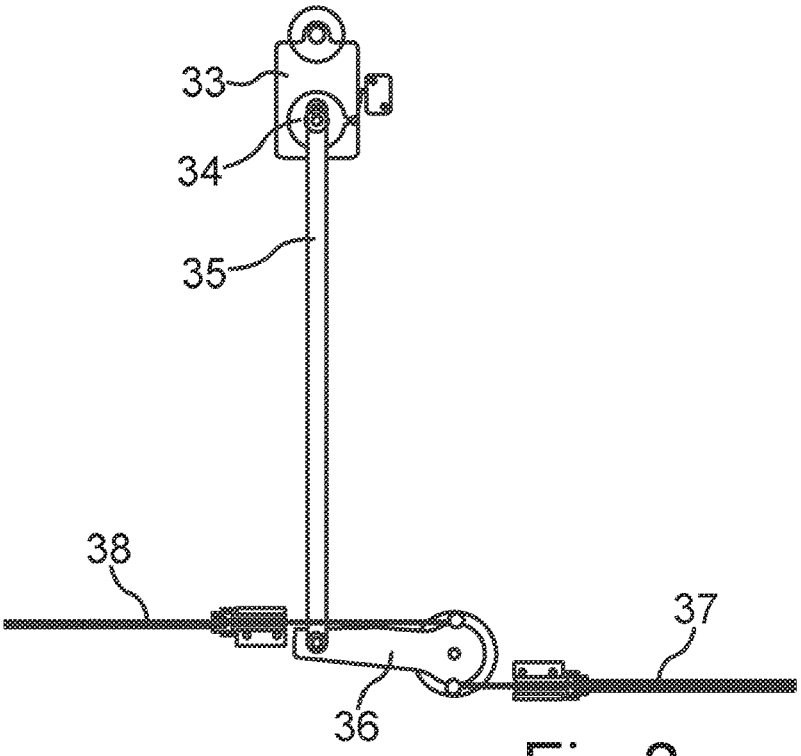
FIG. 8 shows the components of the electromechanical device according to FIG. 6 in an operating state pertaining to the arrangement of the door in the intermediate position according to FIG. 7.

In FIG. 8, the lifting wheel 34, the lifting rod 35 and the cable lever 36 are shown in the operating state and thus the position where the door 3 is in the intermediate position.

In particular, it is provided that with a further actuation of the lifting wheel 34, the cam follower 39 is again automatically returned into its basic position. Thus it is achieved that by a single full revolution of the lifting wheel 34 and thus a revolution of 360° the cam follower 39 is moved from its basic position shown in FIG. 5 into the maximum deflected position shown in FIG. 7 and back again into the basic position.

The invention claimed is:

1. A cooking appliance, comprising:

a housing defining a cooking chamber and having a stowage compartment;

a door for closing the cooking chamber;

a door opening mechanism constructed to automatically move the door at least in a section of an entire movement path between a closed position and an open position of the door, in which open position the door is retractable into the stowage compartment of the housing, said door opening mechanism including an actuation unit configured to automatically tilt the door from the closed position into an intermediate position located such that any further movement of the door from the intermediate position into the open position is implemented automatically under the force of gravity of the door, a hinge configured to pivot and retract the door into the stowage compartment, a main spring having a spring hardness and configured to produce a spring force which acts as a counter to the force of gravity of the door, resulting in a cushioning and/or damping of the movement of the door from the intermediate position into the open position and an auxiliary spring connected to the main spring and having a spring hardness which is lower than the spring hardness of the main spring, wherein the main spring and the auxiliary spring are connected such that on the movement path between the closed position and the intermediate position of the door the auxiliary spring is compressed and the main spring remains alterable in terms of length.

2. The cooking appliance of claim 1, wherein the intermediate position is reached when the door is tilted with a tilt angle between 15° and 30° relative to the closed position.

3. The cooking appliance of claim 1, wherein the intermediate position is reached when the door is tilted with a tilt angle of between 18° and 22° relative to the closed position.

4. The cooking appliance of claim 1, wherein the hinge is configured to pivot and retract the door into the stowage compartment, the hinge including a hinge arm and a cam follower which is coupled to the hinge arm of the hinge, said actuating unit comprising an electromechanical device which is connected by a Bowden cable to the cam follower, such that a pulling force acting on the cam follower via the Bowden cable causes the cam follower to pivot about a pivot axis and the hinge arm to pivot such that the door is automatically tiltable from the closed position into the intermediate position.

5. The cooking appliance of claim 4, wherein the hinge has a hinge housing to which the hinge arm is rotatably connected, said cam follower being pivotably arranged on the hinge housing.

6. The cooking appliance of claim 5, wherein the main spring is attached to the hinge housing said hinge housing being movable on the movement path between the closed position and the intermediate position of the door relative to a fixed attachment point of the auxiliary spring.

7. The cooking appliance of claim 6, further comprising a coupling rod configured to connect the main spring to the auxiliary spring.

8. The cooking appliance of claim 7, wherein the coupling rod is rigid.

9. The cooking appliance of claim 6, wherein the main spring defines a longitudinal axis arranged in parallel or in a linear extension relative to a longitudinal axis of the auxiliary spring.

10. The cooking appliance of claim 6, further comprising a fixed spring cup configured to accommodate the auxiliary spring.

11. The cooking appliance of claim 10, wherein the hinge housing is arranged spaced apart from the spring cup when the door assumes the closed position, and wherein the hinge housing bears against the spring cup when the door assumes the intermediate position.

12. The cooking appliance of claim 6, wherein on the movement path between the closed position and the intermediate position of the door the main spring is inactive relative to a spring force to be effected by an alteration in length.

13. The cooking appliance of claim 6, wherein on the movement path of the door between the intermediate position and the open position the main spring expands, thereby applying a spring force which counteracts the force of gravity of the door.

14. The cooking appliance of claim 4, wherein the electromechanical device comprises a motorized drive, a lifting wheel which is rotatable by the motorized drive, and a lifting rod which is connected to the lifting wheel and to which the Bowden cable is coupled, said lifting rod being movable in a linear manner by a rotation of the lifting wheel to thereby cause actuation of the Bowden cable.

15. The cooking appliance of claim 14, wherein the door is moved from the closed position into the intermediate position, when the lifting wheel undergoes a complete revolution by 360° in response to a chain reaction between the lifting wheel and the hinge arm.

16. The cooking appliance of claim 15, wherein the cam follower is automatically returned to its basic position when the lifting wheel undergoes the complete revolution by 360°.

* * * * *